US007704590B2

(12) United States Patent
Vosseler et al.

(10) Patent No.: US 7,704,590 B2
(45) Date of Patent: Apr. 27, 2010

(54) PRINTING FORM HAVING A PLURALITY OF PLANAR FUNCTIONAL ZONES

(75) Inventors: Bernd Vosseler, Dossenheim (DE); Martin Gutfleisch, Dossenheim (DE); Gerald Erik Hauptmann, Bammental (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 649 days.

(21) Appl. No.: 11/058,039

(22) Filed: Feb. 15, 2005

(65) Prior Publication Data

US 2005/0181187 A1 Aug. 18, 2005

(30) Foreign Application Priority Data

Feb. 17, 2004 (DE) ..... 10 2004 007 600

(51) Int. Cl.
*B41M 5/00* (2006.01)

(52) U.S. Cl. ..... 428/195.1; 101/130; 101/453; 101/454; 101/458.9; 430/279.1; 430/275.1; 430/302; 430/310

(58) Field of Classification Search ..... 428/195.1; 430/310, 275.1, 279.1, 302; 101/130, 453, 101/454, 458.9
See application file for complete search history.

(56) References Cited

U.S. PATENT DOCUMENTS

| | | | | |
|---|---|---|---|---|
| 5,322,763 | A * | 6/1994 | Cairncross et al. | 430/308 |
| 5,570,636 | A * | 11/1996 | Lewis | 101/454 |
| RE35,512 | E * | 5/1997 | Nowak et al. | 101/454 |
| 5,632,204 | A | 5/1997 | Lewis | 101/453 |
| 5,931,097 | A | 8/1999 | Neifert et al. | 101/454 |
| 6,040,115 | A | 3/2000 | Bailey et al. | 430/303 |
| 6,045,964 | A | 4/2000 | Ellis et al. | 430/200 |
| 6,073,559 | A | 6/2000 | Ellis | 101/454 |
| 6,309,799 | B1 * | 10/2001 | Ruckl | 430/306 |
| 6,521,391 | B1 * | 2/2003 | Bennett et al. | 430/275.1 |
| 7,067,232 | B2 * | 6/2006 | Bennett et al. | 430/276.1 |
| 7,073,440 | B2 * | 7/2006 | Langlais et al. | 101/467 |
| 2002/0051934 | A1 | 5/2002 | Nakamura et al. | 430/270.1 |
| 2002/0139269 | A1 | 10/2002 | Riepenhoff et al. | 101/453 |
| 2004/0168599 | A1 | 9/2004 | Riepenhoff et al. | 101/467 |

FOREIGN PATENT DOCUMENTS

| | | |
|---|---|---|
| DE | 101 38 772 | 3/2002 |
| DE | 102 27 054 | 12/2003 |
| DE | 103 54 341 | 6/2004 |
| EP | 0 580 394 | 1/1994 |
| EP | 1 186 407 | 3/2002 |
| EP | 1 245 385 | 10/2002 |

* cited by examiner

*Primary Examiner*—Mark Ruthkosky
*Assistant Examiner*—Tamra L. Dicus
(74) *Attorney, Agent, or Firm*—Davidson, Davidson & Kappel, LLC

(57) ABSTRACT

Imageable printing forms are irradiated by radiant energy corresponding to the image information, the energy being absorbed in the printing form. The energy coupled in this manner is available for patterning the printing form surface. A printing form having a plurality of substantially planar functional zones, which have at least one informational zone that is modifiable in accordance with image information and an absorption zone for absorbing energy from a radiation is distinguished in that a buffer zone is provided which differs at least partially from the absorption zone, receives energy from the absorption zone, and releases energy to the informational zone.

14 Claims, 2 Drawing Sheets

PRINTING FORM HAVING A PLURALITY OF PLANAR FUNCTIONAL ZONES

This claims priority to German Patent Application No. 10 2004 007 600. 6, filed Feb. 17, 2004 and hereby incorporated by reference herein.

BACKGROUND

The present invention is directed to a printing form having a plurality of substantially planar functional zones.

From the related art in the field of planographic printing, in particular offset printing, printing plates, printing belts, printing sleeves and surfaces of printing devices, such as printing cylinders (generally referred to in the following as printing forms) are known, which, following a (re-)imaging process, carry image information and transfer an applied printing ink in accordance with the image information to a medium, such as paper.

Printing forms of this kind frequently have a layered structure, i.e., different layers are superimposed one over the other on a substrate, it being possible to assign special functions, such as absorption or reflection of radiation, and thermal insulation, to these layers.

Typically, the imaging operation includes radiating energy over the full surface or in a controlled manner in accordance with the image information, lasers often being used. In the process, the printing form is heated by the radiated energy, at least on an image dot basis, to the point where its surface temperature locally exceeds a specific transition temperature and a surface chemical or surface physical process takes place, which leads to a change in its affinity to water (or ink). In this manner, the surface of the printing form can be patterned into hydrophilic and hydrophobic (or oleophobic and oleophilic) regions.

From the European Patent Application EP 1 245 385 A2, an imageable wet-offset printing form is known, which has a layered structure. The printing form, i.e., its photocatalytically and thermally modifiable material, for example $TiO_2$, is photocatalytically hydrophilized over the full surface area by ultraviolet radiation and thermally hydrophobized on an image dot basis by infrared radiation, the thermal energy being absorbed by absorption centers in the modifiable material or in an absorption layer underneath this material.

A first embodiment includes a 1 to 30 micrometer thick top layer of $TiO_2$, in which absorption centers (e.g., nanoparticles of a semiconductor material) are dispersed in a fine, uniform distribution, and a sublayer of a material having good thermal conduction and a high thermal capacity for preventing too much heat from diffusing in the lateral direction.

A second embodiment includes an only 0.5 to 5 micrometer thick top layer of $TiO_2$ and a 1 to 5 micrometer thick absorption layer disposed underneath it, from where the absorbed thermal energy can flow back into the top layer.

In both exemplary embodiments, the two layers can be superimposed on a substrate, for example of aluminum, an additional 1 to 30 micrometer thick insulating layer being able to reduce the thermal conduction to the substrate.

U.S. Pat. No. 5,632,204 also describes an imageable offset printing form, which has a polymer surface, a less than 25 nanometer thick, underlying thin metal layer, for example of titanium, for absorbing infrared radiation, and a thermally non-dissipative substrate having pigments that reflect infrared radiation. To image the printing form, it is exposed to infrared laser radiation, which penetrates into the two top layers and is reflected at the substrate back into the metal layer. The thin metal layer can additionally be provided with an antireflection coating, for example of a metal oxide, for the infrared radiation.

In addition, the U.S. Pat. No. 6,073,559 discusses an infrared-imageable offset printing form having a 10 to 500 nanometer thick hydrophilic layer of a metal-nonmetal mixture, a 5 to 500 nanometer thick metal layer, for example of titanium, for absorbing the input infrared radiation, which forms an oxide at its surface, an oleophilic, hard ceramic layer as a thermal insulator, and a substrate. At the surface of the ceramic layer, the incident radiation is reflected back into the metal layer.

Moreover, German Application DE 101 38 772 A1 discusses a rewritable printing form for printing processes using meltable printing ink. The printing form has an external layer which functions as an absorption layer, for example a 0.5 to 5 micrometer thick titanium layer, and an inner layer which functions as an insulation layer, for example a 10 to 100 micrometer thick glass or ceramic layer. Both layers are accommodated on a substrate. The absorption layer has a low thermal capacity and density and, in addition, the insulation layer has a low thermal conductivity.

Another printing form constitutes the subject matter of the still unpublished German DE 102 27 054. This reusable printing form has a metal oxide surface, for example a titanium oxide surface, which is treated with an amphiphilic organic compound whose polar region has an acidic character. By selectively inputting energy on a dot-by-dot basis, for example by infrared irradiation, an image can be produced on the printing form, and, by inputting energy over a large surface area, for example by ultraviolet irradiation, the image can be erased again.

Finally, the subject matter of the still unpublished German DE 103 54 341 is a method for patterning a printing form surface which has a hydrophilizable polymer, by inputting energy, for example by laser radiation, into one region of the printing form surface in which the polymer is hydrophilized, the printing form surface being liquefied and intermixed.

In all of the known printing forms and applied imaging methods, only one portion of the radiated energy is available for the actual imaging process. Another portion of the radiated energy dissipates, unused, due to reflection at the surface or at boundary surfaces between adjacent surfaces and due to transfer by thermal conduction into deeper-lying layers, in particular into the substrate material.

For this reason, a low-power imaging operation, in particular using multi-channel imaging systems, is problematic. To overcome the problem, the related art provides, for example, for using higher power while working with few imaging channels, and a lower imaging speed.

In addition, in the known printing forms, the imaging energy is introduced into an absorption layer from where the energy flows into a layer to be imaged, where it initiates the imaging process. In this context, the energy absorption of the absorption layer is limited by a layer temperature at which damage or destruction to the layer could occur.

For this second reason, however, it is also not possible to select an arbitrarily high power for the imaging system.

SUMMARY OF THE INVENTION

An object of the present invention is to devise an improved printing form which is imageable or reimageable using radiant energy, in particular laser energy, that is minimized as compared to the heretofore related known art.

The present invention provides a printing form having a plurality of substantially planar functional zones, which have at least one informational zone (110, 210, 312, 410) that is modifiable in accordance with image information and an absorption zone (112, 212, 312, 412) for absorbing energy from a radiation (102, 202, 302, 402), wherein a buffer zone (114, 214, 314, 414) is provided which differs at least partially from the absorption zone (112, 212, 312, 412), receives energy from the absorption zone (112, 212, 312, 412), and releases energy to the informational zone (110, 210, 312, 410).

BRIEF DESCRIPTION OF THE DRAWINGS

The present invention, as well as further advantages of the present invention are described in the following in greater detail on the basis of preferred exemplary embodiments with reference to the drawings, in which.

Equivalent or mutually corresponding features in the drawings are denoted by the same reference numerals.

DETAILED DESCRIPTION

Figure 1:
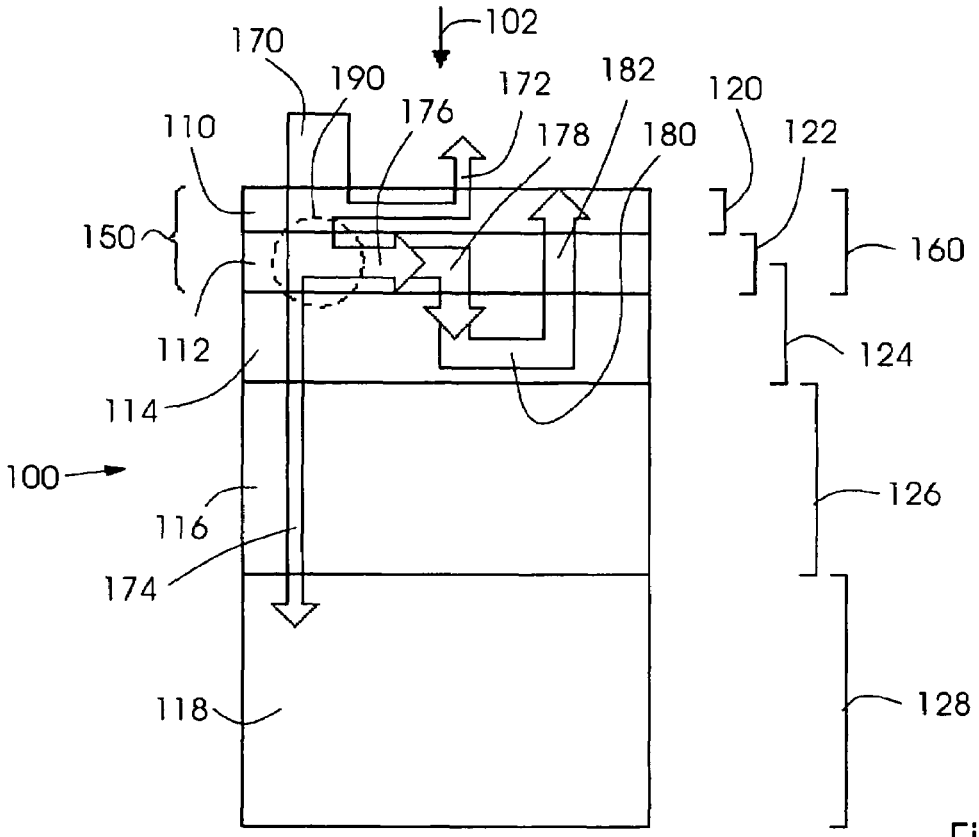
FIG. 1 shows a schematic cross section of the layered structure and of the functional zones of a printing form according to the present invention.

In the detailed description, the following terms are used:

"Functional zone": A region or section of the printing form essentially extending in parallel to the surface of the printing form and essentially having a substantially planar form, which, because of its material composition, its physical and/or chemical properties (e.g., density, thermal capacity, thermal conductivity) and/or its dimension (perpendicularly to the surface of the printing form; in the following: thickness) fulfills a desired function, such as radiative transfer (antireflection), radiation absorption, energy storage (or energy buffering), thermal conduction, thermal insulation, or storage medium for image data. A substantially planar functional zone can be a flat functional zone, e. g. a rectangular shaped zone, or can also be a curved functional zone, e. g. a zone having the form of a cylinder surface. A first functional zone does not necessarily need to be delimited from an adjacent, second functional zone. Rather, functional zones may also penetrate or completely or partially overlap one another. In addition, a functional zone does not necessarily have to be assigned to a layer of the printing form. Rather, a functional zone may also extend completely or partially over a plurality of layers or only over one portion of a layer. It is likewise possible for a plurality of functional zones to be assigned to one layer of the printing form. For example, two zones which differ at least partially from one another may be distinguished from one another by their respective material composition, their particular physical and/or chemical properties, their particular dimensions, and/or by their positions relative to one another.

"Buffer zone": A special functional zone which fulfills the function of storing and, respectively, of buffering energy, in particular thermal energy, and of re-releasing the energy following a time delay to another functional zone. The buffer zone receives the energy supplied to it as an energy flow (e.g., thermal flow) from a first zone, preferably an absorption zone. In the process, the two zones, absorption zone and buffer zone, share the requisite energy absorption tasks: the energy is coupled into the absorption zone and buffer-stored in the buffer zone. The buffer zone re-releases the buffer-stored energy to a second zone, preferably a zone to be modified in accordance with the image information.

A printing form according to the present invention having a plurality of planar functional zones, which have at least one informational zone that is modifiable in accordance with image information and one absorption zone for absorbing energy from a source of radiation, is distinguished in that a buffer zone is provided which differs at least partially from the absorption zone, receives energy from the absorption zone, and releases energy to the informational zone.

The product of thermal conductivity, specific thermal capacity, and density of a material is decisive for the proportion of the input energy that is conducted away from the surface or from a subsurface zone into deeper-lying zones of a printing form and, therefore, does not contribute to the heating of the surface or of the subsurface zone. It is beneficial for this product to be as small as possible in order to reduce or substantially prevent the dissipation of energy into deeper-lying zones.

In the case that not all radiated energy is converted into heat at the surface or in a subsurface zone, but rather first in deeper-lying zones, then this thermal energy must return to the surface or the subsurface zone by thermal conduction.

The time frame required for this process may be distinctly longer than that required for the energy input process based on radiation absorption. In such a case, in accordance with the present invention, the thermal energy required for heating the surface or a subsurface zone may be advantageously buffer-stored or buffered in a buffer zone, the thickness of the buffer zone being able to preferably substantially correspond to the extent of that region reached by the input thermal energy via thermal conduction over the duration of energy input.

In this context, the thermal penetration depth is defined by $$\delta_W = 2 \times \sqrt{\frac{\lambda \times t}{\rho \times c}},$$

in which case, $\lambda$=thermal conductivity, t=input duration, $\rho$=density, and c=specific thermal capacity. Following an input duration of t, a large share of the input thermal energy is distributed within a range of dimension $\delta_w$ around the input location. Given an input duration of, for example, 5 microseconds, the thermal penetration depth in polyimide is approximately 1 micrometer, in titanium, approximately 8 micrometers.

If the thermal energy is coupled into a highly thermally conductive, for example, metallic region (buffer), whose thickness is smaller than the thermal penetration depth (with respect to an infinitely extended buffer zone), and which adjoins a thermally non-dissipative, for example polymer region (insulator), the thermal penetration depth in the insulator being distinctly smaller than the thickness of the buffer, then, in close approximation, all thermal energy is coupled into the buffer with a homogeneous temperature within the buffer.

The above-defined buffer zone may advantageously be designed as such a highly thermally conductive functional zone which preferably adjoins the region of conversion of the radiant energy into thermal energy (i.e., the absorption zone), and which buffer-stores or buffers the input thermal energy.

A highest possible temperature of the buffer zone is beneficial for a most effective thermal conduction from the buffer zone back to the surface or into the subsurface zone. On the other hand, a layered printing-form structure can be damaged or destroyed when a limiting temperature is reached or exceeded.

A buffer zone, whose thickness, density and/or thermal capacity are advantageously selected in such a way that, when buffering the input thermal energy, this limiting temperature is nearly reached (i.e., up to a temperature difference at which it is ensured that no destruction occurs), is referred to in the following as "adapted buffer zone" or simply as "adapted buffer".

The effect of the buffer zone advantageously enables an energy source to be used for the imaging operation using power which is reduced in comparison to related art methods.

One embodiment of the printing form in accordance with the present invention has the feature that the buffer zone is provided at least partially underneath the absorption zone.

In this context, the input energy may advantageously be conducted away from the absorption zone into the deeper-lying buffer zone for purposes of a time-delayed feedback.

Another embodiment of the printing form according to the present invention has the feature that the buffer zone is designed as an adapted buffer zone.

One particularly advantageous embodiment of the printing form according to the present invention has the feature that the buffer zone is designed to be thicker than the absorption zone, in particular to have a thickness of approximately 0.5 to 10 micrometers or a thickness of approximately 1 micrometer.

Another embodiment of the printing form according to the present invention has the feature that the informational zone that is modifiable in accordance with image information is designed as an external zone that carries or is capable of carrying image information.

One embodiment of the printing form according to the present invention that is an alternative to the aforementioned embodiment has the feature that the informational zone that is modifiable in accordance with image information is provided as an external ink layer that carries or is capable of carrying image information.

One other particularly advantageous embodiment of the printing form according to the present invention has the feature that an antireflection zone is provided for the radiation. A particular benefit is derived from the formation of an antireflection zone which allows the radiated energy to attain the absorption zone substantially non-dissipatively and be coupled into the same. Since, in accordance with the present invention, the absorption zone cooperates with the buffer zone, this substantially non-dissipatively input energy is quickly transferred into the buffer zone. In this manner, damage to or even destruction of the zones (and of the corresponding layers) as the result of overheating may be effectively prevented, even under high energy absorption conditions.

In addition to the aforementioned embodiment, another possible embodiment of the printing form according to the present invention is distinguished in that the antireflection zone is formed by the external zone carrying the image information and by the absorption zone.

Another embodiment of the printing form in accordance with the present invention has the feature that a thermal insulation zone is provided at least partially underneath the buffer zone.

This enables a particular benefit to be derived in that the (for example substantially non-dissipatively) input and buffered energy is able to be fed back substantially non-dissipatively into the zone carrying the image information. In this manner, the power of the energy source (e.g., a laser) used for the imaging operation may be advantageously further reduced in comparison to the related art.

In addition to all of the aforementioned embodiments, a distinguishing feature of another possible embodiment of the printing form according to the present invention is that the printing form has a substrate.

Likewise in addition to all of the aforementioned embodiments, another possible embodiment of the printing form according to the present invention has the feature that at least the absorption zone and the buffer zone are designed as separate layers.

The formation of separate layers facilitates the manufacturing of the printing form, in particular with regard to setting the defining parameters of the particular zone, such as thermal capacity, thermal conductivity, and density.

FIG. 1 shows a schematic cross section of the layered structure or of the layer sequence and of the functional zones of a printing form 100 according to the present invention which is irradiated from above by electromagnetic energy, preferably in the form of laser radiation 102 (for example infrared radiation in the wavelength range of 830 nanometers).

From top to bottom, illustrated printing form 100 has five layers 110, 112, 114, 116, 118, which are constituted as follows:

A first layer 110 (cover layer or informational layer 110) is composed of titanium dioxide ($TiO_2$) and preferably has a layer thickness of approximately 50 nanometers (+/− about 10%). This layer 110 forms an external layer 110 of the printing form and, subsequently to the imaging process, preferably bears the image information in the form of a patterning in hydrophilic and hydrophobic regions (patterning in the context of this application also comprises structuring). This layer 110 is already able to at least partially absorb the introduced radiation, however, for the most part, the absorption capacity does not suffice due to the small layer thickness.

A second layer 112 (absorption layer 112) is composed of titanium (or molybdenum), carbon, nitrogen and oxygen (Ti—C, N, O) and preferably has a layer thickness of approximately 250 nanometers (+/−about 50%). In this layer, which preferably absorbs radiation 102 by approximately 80% or more, the energy of laser radiation 102 is highly absorbed and converted into thermal energy. Due to the substantial layer thickness in relation to informational layer 110, the introduced radiation is sufficiently absorbed in this layer 112.

A third layer 114 (buffer layer 114) is composed of a periodic multiple layer of titanium (or molybdenum) and preferably has a layer thickness of more than about 0.5 micrometers and of less than about 10 micrometers, in particular about 1 micrometer. Due to a preferably high thermal capacity of about 1 to 4 millijoule/Kelvin centimeter$^3$, the buffer layer is able to very effectively store the thermal energy coupled into printing form 100. Moreover, due to a preferably high thermal conductivity of buffer layer 114 of preferably about 5 to 50 watt/(meter Kelvin), in particular of about 10 to 20 watt/meter Kelvin), the thermal energy is able to be rapidly transferred and distributed in buffer layer 114.

A fourth layer 116 (insulation layer 116) is composed of polyimide (PI) and preferably has a layer thickness of more than about 10 micrometers, in particular of about 50 micrometers. Due to the low thermal conductivity of this layer of preferably 0.1 to 0.2 watt/(meter Kelvin), hardly any heat transfer (i.e., heat discharge) takes place through the insulation layer to a deeper-lying layer.

A fifth layer 118 (substrate layer or substrate 118) is made of aluminum, for example in the form of a sheet aluminum, and preferably has a layer thickness of about 100 to 250 micrometers. The substrate layer is mechanically stable and forms a base support (i.e., a substrate) for layers 110, 112, 114 and 116 applied thereto.

If the printing form is constituted of a printing cylinder surface, the need is eliminated for substrate 118 or, in other words, the printing cylinder itself may form substrate 118. This applies correspondingly to the other embodiments as well.

Together, informational layer 110 and absorption layer 112 form an antireflection layer 150 or an antireflection system 150, at least for the introduced radiation, i.e., for the relevant wavelength, in such a way that the radiation substantially penetrates, without being reflected, into absorption layer 112. To this end, the layer thicknesses and the respective refractive indices are adjusted to one another. At a given wavelength $\lambda$, the layer thickness of the cover layer is preferably $n\lambda/4$, n being an uneven integer preferably greater than 5. In this context, the refractive index of informational layer 110 is between the refractive index of air and the refractive index of the layer situated underneath informational layer 110 and is preferably the root of the refractive index of the layer situated underneath informational layer 110.

A buffer layer may also be provided over absorption layer 112, it being necessary for this buffer layer to be substantially transparent to the introduced radiation.

In addition to the layered structure, the functional zones of printing form 100 are also illustrated by lines. As is apparent from FIG. 1, functional zones may conform, on the one hand, with individual layers of the layered structure and, on the other hand, include a plurality of layers (fully or partially). In addition, it is clear that individual layers may also be assigned to a plurality of functional zones.

The functional zones are derived from top to bottom as follows:

A first functional zone 120 (zone that carries or is capable of carrying image information, or informational zone 120) is defined by thermally induced surface physical and/or surface chemical processes and/or coating processes which underlie a patterning of printing form 100 in this functional zone 120 in conformance with the image information. Therefore, this zone is modifiable in accordance with image information in that the previously largely unpatterned zone is patterned following the imaging operation in conformance with the image.

A second functional zone 122 (absorption zone 122) is defined by an absorption capacity for introduced radiation 102 and by a conversion of the radiant energy into thermal energy, in the region of absorption zone 122, the material being able to absorb approximately 80% or more of radiation 102. The optical penetration depth for introduced radiation 102 is preferably substantially smaller than or equal to the thickness of absorption zone 122.

A third functional zone 124 (buffer zone 124) is defined by a storage or buffer capacity for the input thermal energy. Due to a preferably high thermal capacity of the material located in the region of buffer zone 124 of preferably about 1 to 4 millijoule/Kelvin centimeter$^3$, buffer zone 124 is able to very effectively store the thermal energy coupled into printing form 100. Moreover, due to a preferably high thermal conductivity of the material contained in the region of buffer zone 124 of preferably about 5 to 50 watt/(meter Kelvin), in particular of about 10 to 20 watt/meter Kelvin), the thermal energy is able to be rapidly transferred and distributed in buffer zone 124.

A fourth functional zone 126 (insulation zone 126) is defined by an insulating property which enables a thermal flow from buffer zone 124 (or an intermediate zone), i.e., from the assigned layer, situated above insulation zone 126, into the zone, i.e., the assigned layer, situated underneath insulation zone 126, to be reduced or essentially completely prevented. For this purpose, the material which makes up the insulation zone preferably has a low thermal conductivity of about 0.1 to 0.2 watt/(meter Kelvin).

A fifth functional zone 128 (substrate zone 128) is defined by a mechanical stability in the manner that substrate zone 128 (i.e., assigned substrate 118) is suited for accommodating the other functional zones (i.e., the assigned layers) to form a flexible unit 100 (printing form 100) that is mechanically stable in the direction of the superficial extent of the zones and is preferably bendable perpendicular to the surface of the zones. Such a substrate 118, for example a metallic substrate 118, is particularly useful for large sized printing forms. Substrate zone 128 preferably has a small thickness and a high modulus of elasticity.

Another functional zone 160 (antireflection zone 160) is defined by an antireflection property (i.e., transmission property) for introduced radiation 102, so that radiation 102 penetrates substantially unreflected, preferably with a reflection coefficient of less than about 20%, into the deeper-lying absorption zone. Antireflection zone 160 encompasses informational zone 120 and absorption zone 122. As already explained with regard to antireflection layer 150, the thickness of underlying zone 120 is to be coordinated with the wavelength of radiation 102.

In addition, FIG. 1 shows the energy flow. Energy 170, in the form of electromagnetic radiation 102, radiated onto the layered structure of printing form 100, is only slightly dissipated by reflection 172 (reflection loss 172), preferably by less than about 20%, so that, initially, only this portion 172 of radiated energy 170 is not available for the actual imaging process. In addition, thermal energy 190, which is coupled into absorption zone 122, is only slightly dissipated by transfer 174 (transfer loss 174) into substrate 118, preferably by less than about 5%, in particular 1%, and this portion 174 of radiated energy 170 is therefore likewise not available for the actual imaging process. The predominant proportion 176 (stored thermal energy 176) of input thermal energy 190, preferably more than about 75%, in particular 80%, however, is received via thermal conduction 178 by buffer zone 124, which is at least partially situated at a deeper location than absorption zone 122, and is buffered temporally and spatially as buffered thermal energy 180. Following a time delay, via thermal conduction 180, thermal energy 180 from buffer zone 124 again attains absorption zone 122 and informational zone 120, where the thermal energy is required for the actual (physical or chemical) imaging process.

Figure 2:
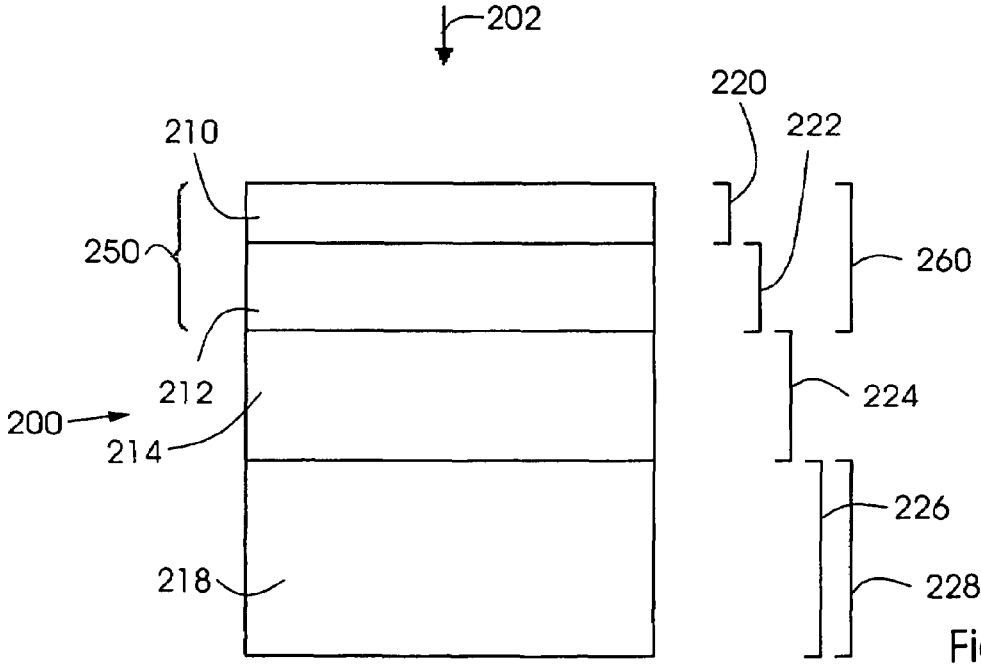
FIG. 2 illustrates a schematic cross section of the layered structure and of the functional zones of another printing form according to the present invention.

FIG. 2 shows a schematic cross section of the layered structure or of the layer sequence of another printing form 200 according to the present invention, which is irradiated from above by laser radiation 202, preferably in the infrared region, for imaging purposes.

The statements made with reference to FIG. 1 regarding the informational layer (respectively zone), the absorption layer (respectively zone), and the buffer layer (respectively zone), with respect to functionality, the processes during the imaging operation, in particular the energy flow, and the advantages, apply correspondingly to the printing form according to FIG. 2 as well. The terms introduced with reference to FIG. 1 are employed here correspondingly.

From top to bottom, illustrated printing form 200 has four layers:

A first layer 210 (cover layer or informational layer 210) is composed of silicon dioxide ($SiO_2$) and preferably has a layer thickness of approximately 50 nanometers (+/−about 10%).

A second layer 212 (absorption layer 212) is composed of $TiN_xO_{2-x}$ and preferably has a layer thickness of approximately 250 nanometers (+/−about 50%).

A third layer 214 (buffer layer 214) is composed of metallic titanium and preferably has a layer thickness of about 1 to 10 micrometers, preferably about 1 micrometer.

A fourth layer 218 (insulation and substrate layer 218) is composed of polyimide and preferably has a layer thickness of about 100 to 300 micrometers, preferably about 250 micrometers. In this layer 218, the layer material polyimide fulfills both the substrate function as well as the insulation function.

In this embodiment as well, informational layer 110 and absorption layer 112 together form an antireflection layer 250 or an antireflection system 250, at least for introduced radiation 202, i.e., for the relevant wavelength, in such a way that the radiation substantially penetrates, without being reflected, into absorption layer 212.

In addition to the layered structure, the functional regions are again illustrated by lines. The functional zones are derived from top to bottom as follows:

A first functional zone 220 forms informational zone 220;

A second functional zone 222 forms absorption zone 222;

A third functional zone 224 forms buffer zone 224;

A fourth functional zone 226 forms insulation zone 226;

A fifth functional zone 228 forms substrate zone 228;

Another functional zone 260 forms antireflection zone 222.

Figure 3:
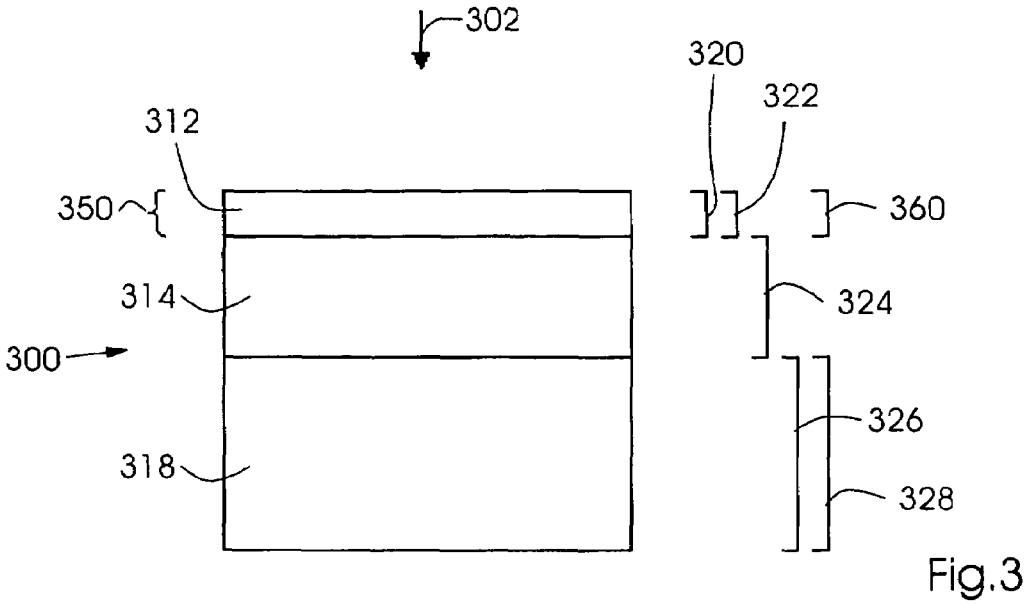
FIG. 3 depicts a schematic cross section of the layered structure and of the functional zones of another printing form according to the present invention.

FIG. 3 shows another embodiment of the present invention for a printing form 300 having amphiphilic molecules that has been optimized with respect to the degree of utilization of introduced radiation 302.

Illustrated printing form 300 is preferably composed of three layers:

An approximately 100 to 500 nanometer thick first layer 312 (absorption layer 312) of titanium, carbon, nitrogen and oxygen (Ti—C, N, O). Other materials or material systems, which have a low optical penetration depth, may likewise be used, however. The material employed should either satisfy the imaging/process requirements at least at the surface (here, the absorption layer, at least on its outer side, is, at the same time, the cover or informational layer) or, however, be provided with an additional outer layer (in this case, a separate cover or informational layer exists), such as $TiO_2$, which satisfies these requirements. Layer 312 exhibits a reflectance of preferably less than about 20% for radiation 302, i.e., absorption layer 312 is able to simultaneously fulfill an antireflection function and, respectively, form an antireflection layer.

An approximately 0.3 to 10 micrometer, preferably 0.5 to 2 micrometer thick second layer 314 (buffer layer 314) of stainless steel. Instead of stainless steel, another material having good thermal conductivity properties in comparison to a polymer may also be selected, in which case, the heat absorption per unit area and degree Kelvin (J/($m^2$K)) should correspond more or less to that of 500 nanometers of stainless steel. In addition, a periodic layer stack of two or more materials, preferably metals (for example, molybdenum and/or titanium) may be provided.

An approximately 100 to 300 micrometer thick substrate layer 318 of polyimide film (respectively, Kapton®), which, in addition to the substrate function, also fulfills the thermal insulation function; i.e., substrate layer 318 forms the insulation layer at the same time. In addition to polyimide, other polymers are also conceivable which withstand the special thermal, chemical and mechanical influences and stresses during the imaging or printing processes.

In place of a polymer film, a substrate of sheet metal, preferably of steel or aluminum sheet metal may also be used, the sheet metal preferably being able to be provided with an approximately 10 or only approximately 5 micrometer thick polyimide layer (e.g., by adhesive bonding).

Another layer which is optionally applied to absorption layer 312 and may be used as an informational layer, and which, together with absorption layer 312, forms an antireflection layer 350, may be formed as a $TiO_2$ layer, for example, which, by destructive interference, reduces the reflection of the irradiated light (for example: refractive index of $TiO_2$ is 1.8, assuming a wavelength of 900 nanometer and a thickness of 125 nanometers).

Besides titanium (Ti), its oxides or nitrides, it is also possible to use zirconium (Zr), manganese (Mn), aluminum (Al), chromium (Cr), tantalum (Ta), tin (Sn), zinc (Zn) and iron (Fe), their oxides or nitrides or mixtures thereof in layer 312 (i.e., in the additional antireflection coating).

In this embodiment, only very little thermal conduction is needed to transfer the input thermal energy since the input already takes place very close to the surface. For that reason, a very thin buffer layer 314 may advantageously be provided, which additionally has the task of protecting the layer interface between polyimide film 318 and its coating from excessive thermal stress.

The Ti—C, N, O layer 312 may be hydrophobized by amphiphilic molecules and then hydrophilized again by laser imaging using an infrared laser (wavelength 1=700 to 1100 nanometers, power P=150 milliwatts to 0.5 watts). Layer 312 is terminated by amphiphilic molecules (e.g., stearin phosphonic acid) following an activation of layer 312 by ultraviolet light (Xe2, Hg emitters or atmospheric pressure plasma) by wetting with a 1 millimolar ethanol solution of the amphiphilic molecules, and subsequent rinsing of layer 312 with the solvent, and drying with $N_2$.

Moreover, layer 312 is very abrasion-resistant, which is beneficial to the stability in the printing process.

The polyimide substrate material provides an effective thermal insulation, so that the input thermal energy is substantially used for heating an only 600 nanometer thick region at the surface. In this way, the imaging temperature is able to be reached already at a low laser power.

Besides the layer sequence of printing form 300, the functional zones are again illustrated by lines in FIG. 3: an informational zone 320, an absorption zone 322, a buffer zone 324, an insulation zone 326, a substrate zone 328, and an antireflection zone 360.

Figure 4:
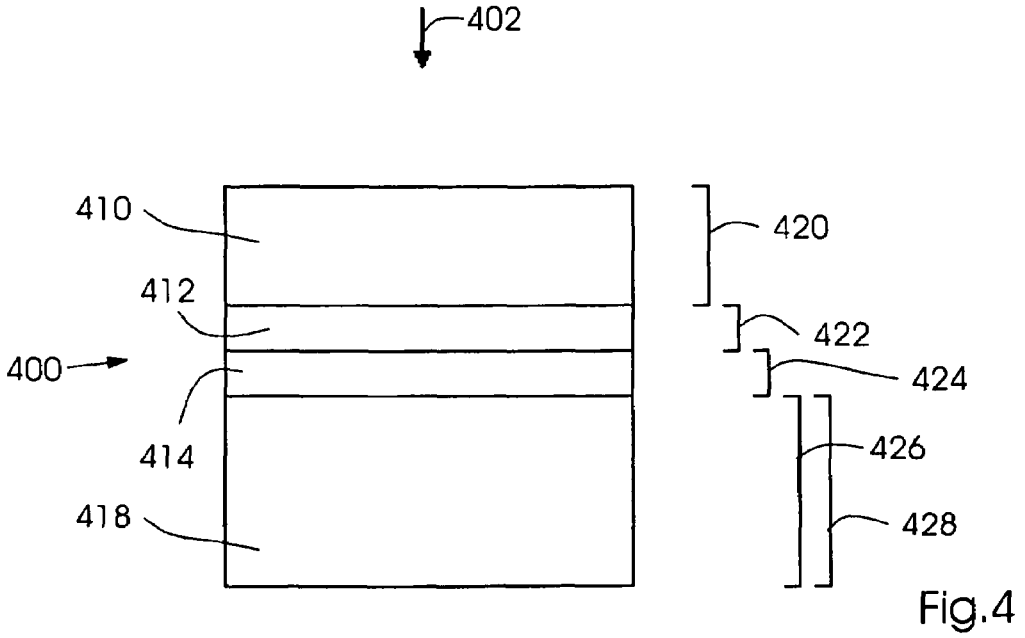
FIG. 4 is a schematic cross section of the layered structure and of the functional zones of another printing form according to the present invention.

FIG. 4 depicts another embodiment of the present invention for a printing form 400 which is based on the principle of thermal intermixing and is irradiated by laser radiation 402 during an imaging process in conformance with the image information. Illustrated printing form 400 is preferably composed of three layers:

An approximately 1 to 10 micrometer thick informational layer 410 of a meltable and chemically hydrophilizable polymer which may be thermally intermixed;

An approximately 100 to 500 nanometer thick absorption layer 412 of titanium, carbon, nitrogen and oxygen (Ti—C, N, O) or chromium, carbon, nitrogen and oxygen (Cr—C, N, O);

An approximately 2 to 5 micrometer thick buffer layer 414 of molybdenum. Instead of molybdenum, another material having good thermal conductivity properties in comparison to a polymer may also be selected, in which case, the heat absorption per unit area and degree Kelvin (J/($m^2$K)) should correspond more or less to that of 2 micrometers of molybdenum. Alternatively, a periodic layer stack of two or more materials, preferably metals (for example, molybdenum and/or titanium) may be provided.

An approximately 100 to 300 micrometer thick substrate layer 418 of polyimide film (respectively, Kapton®), which, in addition to the substrate function, also fulfills the thermal insulation function. Alternatives to the polyimide film are possible in accordance with the exemplary embodiment represented in FIG. 3.

The polymer surface is, by nature, hydrophobic and can be hydrophilized over a large area by a treatment with chemicals, e.g., with KMnO4 or by a plasma or ultraviolet treatment, the penetration depth of such processes typically not exceeding 10 nanometers.

If, at this point, the polymer is melted, then deeper-lying, non-hydrophilized molecules intermix with hydrophilized molecules of the treated surface. Once the polymer solidifies, the proportion of hydrophilized molecules at the surface is as great as their proportion in the polymer layer altogether, i.e., given, for example, 1 nanometer hydrophilization depth and 5 micrometer layer thickness, only 0.2 per thousand. Thus, the solidified polymer layer again exhibits its hydrophobic character.

Therefore, by using a diode laser, the previously hydrophilized printing form is able to be effectively imaged, i.e., hydrophobized on a dot-by-dot basis in a melting-on (superficial fusion) and thermal intermixing operation.

Since, in this process, the thermal energy is directed through heat conduction to the surface of printing form 400 (thus to the polymer surface), and it is necessary to heat a larger volume (buffer layer 414 and polymer layer 410) and produce the enthalpy of melting, clearly more energy needs to be stored than in the exemplary embodiment represented in FIG. 3. This embodiment allows for this by providing a thicker buffer layer 414.

Besides the layer sequence of printing form 400, the functional zones of printing form 400 are again illustrated by lines in FIG. 4: an informational zone 420, an absorption zone 422, a buffer zone 424, an insulation zone 426, and a substrate zone 428.

All illustrated embodiments have in common that functional zones may be assigned to printing forms 100, 200, 300 and 400, the functional zones preferably having the following properties:

Cover or informational zone: high degree of abrasion resistance and good thermally induced patternability in conformance with the image information to be produced;

Absorption zone: high absorption capacity, i.e., low optical penetration depth, at least for the radiated imaging wavelength, due to a high concentration of absorption centers at least near the surface, e.g., within a range of less than an approximately 200 nanometer depth;

Buffer zone, respectively adapted buffer zone: high thermal capacity and thermal conductivity; preferably large thickness in comparison to the absorption zone;

Insulation zone: low thermal conductivity and/or low thermal capacity in comparison to the buffer zone;

Substrate zone: sufficient mechanical stability, high modulus of elasticity;

Antireflection zone: low reflection, at least for the imaging wavelength.

The present invention is also applicable to printing processes in which the print image is written by laser radiation into a full-surface ink layer on the printing form. In the process, the initially hard ink layer is liquefied at the imaging spots and, because of an appropriately specified delay in the solidification of the printing ink, the print image is able to be transferred to a stock.

In this embodiment of the present invention, the printing form has a substrate layer (corresponding to 118 in FIG. 1), an insulation layer (corresponding to 116 in FIG. 1), the substrate and the insulation layer also being able to form one unit (corresponding to 218 in FIG. 2), and a buffer layer (corresponding to 114 in FIG. 1). The absorption layer (corresponding to 112 in FIG. 1) and also the informational layer (corresponding to 110 in FIG. 1) are formed by the applied ink layer. Alternatively, the absorption layer may also be situated underneath the ink layer.

REFERENCE NUMERAL LIST

100 printing form
102 laser radiation
110 cover layer/informational layer
112 absorption layer
114 buffer layer
116 insulation layer
118 substrate layer/substrate/cylinder
120 informational zone
122 absorption zone
124 buffer zone
126 insulation zone
128 substrate zone
150 antireflection layer/antireflection system
160 antireflection zone
170 radiated energy
172 reflection loss
174 transfer loss
176 stored thermal energy
178 heat conduction
180 buffered thermal energy
182 heat conduction
190 input thermal energy
200 printing form
202 laser radiation
210 informational layer
212 absorption layer
214 buffer layer
218 insulation and substrate layer/substrate
220 informational zone
222 absorption zone
224 buffer zone
226 insulation zone
228 substrate zone

250 antireflection layer/antireflection system
260 antireflection zone
300 printing form
302 laser radiation
312 absorption layer
314 buffer layer
318 substrate layer/substrate
320 informational zone
322 absorption zone
324 buffer zone
326 insulation zone
328 substrate zone
350 antireflection layer/antireflection system
360 antireflection zone
400 printing form
402 laser radiation
410 informational layer
412 absorption layer
414 buffer layer
418 substrate layer/substrate
420 informational zone
422 absorption zone
424 buffer zone
426 insulation zone
428 substrate zone

What is claimed is:

1. A printing form having a plurality of substantially planar functional zones, the printing form comprising:

at least one informational zone being modified in accordance with image information in the form of a patterning in hydrophilic and hydrophobic regions, the at least one informational zone being an external layer;

an absorption zone absorbing energy from radiation; and a buffer zone receiving energy from the absorption zone thereby preventing damage or destruction of the informational and absorption zones and releasing the absorbed energy to the informational zone, the buffer zone at least partially differing from the absorption zone, a thickness of the buffer zone being smaller than a thermal penetration depth of the buffer zone.

2. The printing form as recited in claim 1 wherein the buffer zone is arranged to be at least partially beneath the absorption zone.

3. The printing form as recited in claim 1 wherein the buffer zone comprises an adapted buffer zone, having at least one of a thickness, a density and a thermal capacity selected in such a way that when buffering an input thermal energy a limiting temperature, defined as a temperature at which a layered printing-form structure can be damaged or destroyed, is nearly reached.

4. The printing form as recited in claim 1 wherein the buffer zone has a greater thickness than the absorption zone.

5. The printing form as recited in claim 4 wherein the buffer zone has a thickness of approximately 0.5 to 10 micrometers.

6. The printing form as recited in claim 5 wherein the buffer zone has a thickness of approximately 1 micrometer.

7. The printing form as recited in claim 1 wherein the informational zone is an external zone that is capable of carrying image information.

8. The printing form as recited in claim 7 wherein the informational zone is an external ink layer.

9. The printing form as recited in claim 7 wherein the informational zone is a polymer layer.

10. The printing form as recited in claim 1 wherein the printing form has an antireflection zone.

11. The printing form as recited in claim 10 wherein the antireflection zone comprises the informational zone and the absorption zone.

12. The printing form as recited in claim 1 further comprising a thermal insulation zone, the thermal insulation zone being at least partially beneath the buffer zone.

13. The printing form as recited in claim 1 further comprising a substrate.

14. The printing form as recited in claim 1 wherein at least the absorption zone and the buffer zone are separate layers.

* * * * *